US009394130B2

(12) United States Patent
Dirksz et al.

(10) Patent No.: US 9,394,130 B2
(45) Date of Patent: Jul. 19, 2016

(54) METHOD FOR CALIBRATING ACCURATE PAPER STEPS

(71) Applicant: OCE-TECHNOLOGIES B.V., Venlo (NL)

(72) Inventors: Daniël A. Dirksz, Venlo (NL); Sjirk H. Koekebakker, Venlo (NL); Juan C. Pérez Muñoz, Venlo (NL); Jeroen J. G. Coenen, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/750,720

(22) Filed: Jun. 25, 2015

(65) Prior Publication Data

US 2015/0375537 A1 Dec. 31, 2015

(30) Foreign Application Priority Data

Jun. 26, 2014 (EP) ..... 14174460
Dec. 11, 2014 (EP) ..... 14197454

(51) Int. Cl.

*B65H 20/02* (2006.01)
*B41J 13/00* (2006.01)
*B65H 5/06* (2006.01)
*B41J 11/46* (2006.01)

(52) U.S. Cl.

CPC ..... *B65H 20/02* (2013.01); *B41J 11/46* (2013.01); *B41J 13/0027* (2013.01); *B65H 5/06* (2013.01); *B65H 2220/03* (2013.01); *B65H 2403/46* (2013.01); *B65H 2404/143* (2013.01); *B65H 2511/11* (2013.01); *B65H 2511/166* (2013.01); *B65H 2511/24* (2013.01); *B65H 2511/512* (2013.01); *B65H 2553/51* (2013.01); *B65H 2557/61* (2013.01); *B65H 2801/36* (2013.01)

(58) Field of Classification Search

CPC .... B65H 20/02; B65H 5/06; B65H 2404/143; B65H 2511/11; B65H 2511/166; B65H 2220/03; B65H 2511/512; B65H 2553/51; B65H 2557/61; B65H 2801/36; B65H 2403/46; B41J 13/0027; B41J 11/46

See application file for complete search history.

(56) References Cited

U.S. PATENT DOCUMENTS

| | | | |
|---|---|---|---|
| 5,529,414 | A | 6/1996 | Katano et al. |
| 6,336,702 | B1 | 1/2002 | Zapata et al. |
| 7,980,655 | B2 | 7/2011 | Nakano et al. |
| 2002/0037191 | A1 | 3/2002 | Lesniak et al. |

(Continued)

FOREIGN PATENT DOCUMENTS

| | | |
|---|---|---|
| EP | 1 782 960 B1 | 7/2008 |

*Primary Examiner* — Justin Seo

(74) *Attorney, Agent, or Firm* — Birch, Stewart, Kolasch & Birch, LLP

(57) ABSTRACT

A method for accurately controlling a medium displacement in an inkjet printer is provided by accurately determining a relation between an actuation signal for a drive motor and a medium displacement. The method comprises the steps of establishing a set of calibration actuation signals each corresponding to a nominal calibration step and determining an achieved medium displacement step for each calibration actuation signal in the set. The set comprises at least one calibration actuation signal for actuating the drive motor to make one full revolution and at least one calibration actuation signal for actuating the drive motor to make a rotation larger than one full revolution, but smaller than two full revolutions. Both a cyclic deviation and a local deviation of the nominal displacement relation is determined based on a finite series of basis functions.

6 Claims, 2 Drawing Sheets

(56) References Cited

U.S. PATENT DOCUMENTS

2002/0097293 A1 7/2002 Castelli et al.
2004/0179217 A1 9/2004 Chapman et al.
2007/0085891 A1* 4/2007 Batalla ..... B41J 11/425 347/104
2007/0098476 A1 5/2007 Goeree et al.
2010/0078870 A1* 4/2010 Fellingham ..... B41J 2/2132 271/8.1
2014/0078206 A1* 3/2014 Emoto ..... B41J 13/0009 347/16

* cited by examiner

METHOD FOR CALIBRATING ACCURATE PAPER STEPS

BACKGROUND OF THE INVENTION

1. Field of the invention

The present invention relates to methods for accurately controlling a medium displacement in an inkjet printer, inkjet printers having a control unit that is configured to determine a relation between an actuation signal and a medium displacement, and methods for determining a relation between an actuation signal and a medium displacement in an inkjet printer.

2. Description of the Related Art

Among the various types of inkjet printers, a scanning-type inkjet printer is known, wherein a recording medium is transported in a specified, transport direction and a carriage, comprising multi-nozzle printheads for applying variously colored inks, is reciprocating in a scanning direction perpendicular to the transport direction in order to print swaths of ink dots, thereby generating an image on the recording medium. During a scanning movement of the carriage across the recording medium, the medium position is fixed. The advancement of the recording medium is performed stepwise at the time the carriage reverses its movement. The accuracy of a recording medium advancement, also known as a paper step, is known to be important, because contiguous swaths applied by the printheads are to complement each other. An inaccurate paperstep would cause a light or dark border line or area between the swaths.

A drive mechanism for achieving accurate papersteps is known e.g. from European Patent 1782960 B1. This mechanism comprises a feed roller having the recording medium pinched onto its surface. Thus, the surface movement of the roller is transferred to the medium. The roller is driven by a drive motor with an angular encoder, or an angle encoding device, on its axis and a slip free transmission that provides a high transmission ratio. A suitable transmission is, amongst others, a worm/wormwheel gear, a gearbox or a toothbelt, possibly multi stage. This has the advantage that a small advance increment of the roller and the medium corresponds to a relatively large angular increment of the motor axis, enabling a high control accuracy of the medium transport. A further advantage is that a full revolution of the motor and the intermediate gear corresponds to an applicable basic stepsize of roller and medium combination. This enables the use of papersteps that correspond to an integer number of basic stepsizes, equivalent to an integer number of full revolutions of the motor axis and the intermediate gear. This helps to achieve a high accuracy in a similar way as is described in U.S. Pat. No. 5,529,414.

In principle, a linear relation exists between an actuation signal, causing the drive motor to rotate to a corresponding angular position of the motor axis, and a displacement of a recording medium, or paper. However, due to eccentricities, unroundness and dimensional errors of the roller, the motor axis, and the transmission, regular, repeating deviations from this linear relation occur. These deviations, or errors, as a function of the actuation signal, or a corresponding circumferential position of the roller, have different frequencies due to the different rotation velocities of the components. A smallest repeating deviation frequency may be identified, associated with the roller and its transmission. This is often the roller frequency, but may also be, for example, the least common multiple of the roller and a belt circumference. By printing a first marker pattern, or reference mark, on the recording medium, displacing the medium over a distance equal to a basic stepsize, printing a second marker pattern besides the first one, usually with a different part of the printhead, and comparing the positions of the two markers, a good estimation of the difference between an actual paper stepsize and a nominal basic stepsize may be obtained. Repeating this procedure enables the determination of this difference in dependence on the angular position of the motor axis and the circumferential position of the roller. A table may be drafted, relating an actuation signal for an integer number of basic stepsizes to a deviation between an actual medium displacement and its nominal value. This table is used by a controlling unit to adjust the actuation signal associated with a required paper step. To appropriately phase the compensation, at least one known configuration or position of the transmission is to be measured, using, for example, a home sensor on the roller. Frequencies which are associated with rotating components other than the roller, may be ignored, due to the fact that these rotating components make full revolutions only. Thus, a full cycle of the higher frequencies is completed.

The method sketched above limits the use of the medium transport mechanism to an integer number of basic stepizes only. This may not suffice to design different print strategies. For example, a basic stepsize of one eigth of a swathwidth allows the application of a four-pass print strategy by using a stepsize of two basic steps or the application of a two-pass print strategy by using a stepsize of four basic steps, but it is incompatible with a six-pass print strategy applying a stepsize of one sixth of a swathwidth. In that case, the higher frequencies do play a role and can not be ignored. U.S. Pat. No. 7,980,655 provides a method for determining a deviation for these high frequencies. In this method a plurality of markers is printed, with the application of a medium displacement that is smaller than the basic stepsize equivalent to a full rotation of the driving components. Unfortunately, if the basic stepsize is rather small, this method does not provide the required accuracy. This is due to the fact that paperslip causes a form of transient behaviour in the displacement of the medium, that is relatively large when a medium step is small. Furthermore, a small stepsize limits the size of the marker that is used to determine the actual paperstep and a smaller marker results in a less accurate determination.

Therefore, a problem exists for determining an accurate relation between a medium displacement and an actuation signal for a medium displacement system with rotating driving components. An object of the present invention is to provide a method that solves the above-mentioned shortcomings.

SUMMARY OF THE INVENTION

According to the present invention, a method for accurately controlling a medium displacement in an inkjet printer is provided. A relation is determined between an actuation signal and a medium displacement, the actuation signal causing a rotation of a roller by actuating a drive motor that is coupled to the roller by a transmission such that the rotation speed of the drive motor is higher than the rotation speed of the roller that passes its surface movement to a medium pinched onto its surface. The method comprises the steps of: a) establishing a set of calibration actuation signals each corresponding to a nominal calibration step; b) printing a first reference mark on the medium; c) selecting a calibration actuation signal from the set of calibration actuation signals; d) actuating the drive motor to cause the roller to displace the medium over a distance of the nominal calibration step corresponding to the selected calibration actuation signal; e) printing a next reference mark besides the first reference mark in a direction perpendicular to the medium displacement direction; f) optically reading the first and the next reference mark; g) determining an achieved medium displacement step from the read reference marks; and h) repeating steps b) to g) for all available calibration actuation signals in the set of calibration actuation signals, wherein the set of calibration actuation signals comprises at least one calibration actuation signal that actuates the drive motor to make one full revolution and one calibration actuation signal that actuates the drive motor to make a rotation larger than one full revolution, but smaller than two full revolutions, and determining a relation between the calibration actuation signals and the difference between the achieved medium displacement steps and the nominal calibration steps, based on a finite series of basis functions. These basis functions comprise a set of parameters with values that are established from the difference measurements by the use of multivariate linear regression. The use of the different stepsizes enables the determination of parameters associated with frequencies that otherwise would fall outside the scope of measurement. The stepsize larger than one full revolution of the drive motor is used to sample variations with high frequency through undersampling.

In a further embodiment, the set of calibration actuation signals comprises two different values, that are applied a number of times in dependence on a required accuracy. A minimum number of measurements is needed to be able to determine a value for all parameters in the basis functions. However, since noise is comprised in every measurement, the accuracy of the parameter value estimation is increased by additional measurements.

In an alternative embodiment, the set of calibration actuation signals comprises a number of randomly selected values, each calibration actuation signal value separately actuating the drive motor to make a rotation between one full revolution and two full revolutions. This alternative is particularly useful when the frequencies of the deviations in the achieved medium displacement are unknown and are part of the estimation process. In fact, the basis functions comprise an additional parameter that is to be estimated.

In a further embodiment, the finite series of basis functions comprise a number of circular functions with a predetermined primitive period. The primitive period has the lowest frequency and is associated with the smallest repeating deviation frequency associated with the roller and its transmission. In a system wherein this smallest frequency corresponds to a number of full revolutions of the drive motor and the transmission, the deviations in the achieved medium displacement show predominantly frequencies that are a multiple of this lowest frequency.

The present invention may also be embodied in an inkjet printer wherein a medium is transported to be printed in swaths, the inkjet printer having a control unit that is configured to execute the described method.

Further scope of applicability of the present invention will become apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not imitative of the present invention, and wherein.

DETAILED DESCRIPTION OF EMBODIMENTS

Figure 1:
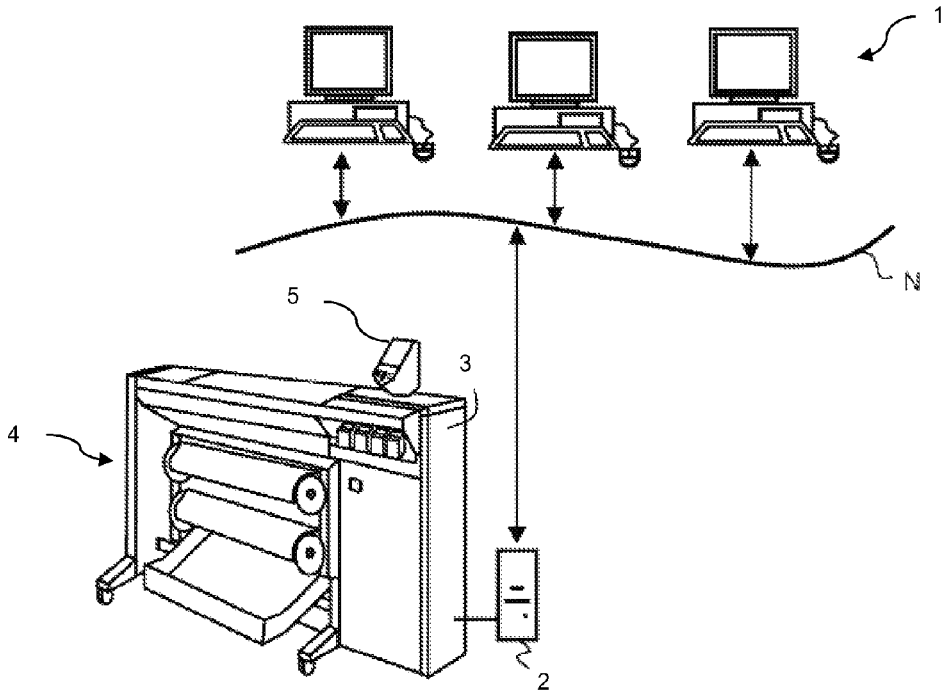
FIG. 1 shows a print system wherein the invented method is applied.

The present invention will now be described with reference to the accompanying drawings, wherein the same or similar elements are identified with the same reference numeral.

The print system as shown in FIG. 1 is an example of a print system wherein the invented method is applicable. This system comprises a number of work stations 1 that are configured to dispatch print jobs over network N to a print controller, or digital front end, 2, that assembles the print jobs and schedules them for processing on printer 3. Alternatively, the controller 2 may be connected to multiple print engines, each configured for particular print jobs. Print engine 3 is a wide format printer, having multiple media rolls 4. Each medium is calibrated separately with respect to accurate medium transport depending on the medium type. Local user interface 5 is used to start and stop a calibration procedure for a freshly introduced medium. Not shown is the embedded CPU that controls the behaviour of the print engine 3.

Figure 2:
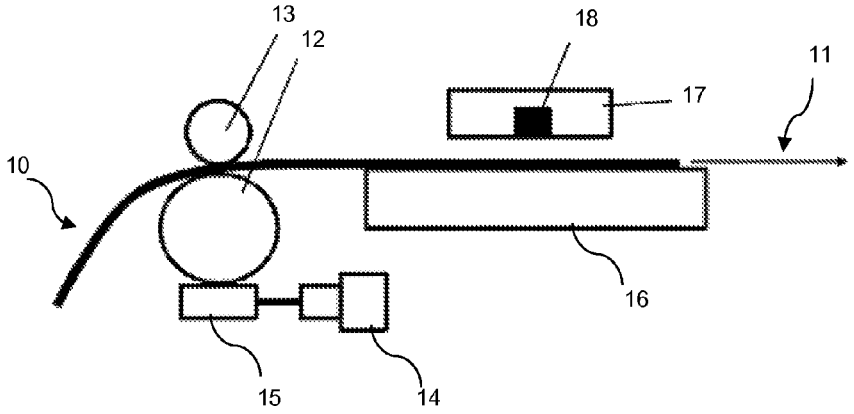
FIG. 2 shows a number of functional elements that are used in determining a medium displacement.

In FIG. 2 the transport of a recording medium in the print engine is shown. Medium 10 is transported in the transport, or subscanning, direction 11. A carriage 17 that comprises a number of printheads (not shown) and an optical capturing element 18 reciprocates in a direction perpendicular to the transport direction across the recording medium. A paperstep in the transport direction 11 is made during a movement reversal of the carriage. Alternatively, in the case of monodirectional printing, it occurs during a reverse movement of the carriage, but in any case, the medium is only transported at a time that no ink is applied to the medium 10. The print surface 16 defines the position of the print medium relative to the printheads in the carriage. In the case thick media are applied, the height of the print surface may have to be adjusted to maintain a predetermined distance between the printheads and the medium surface. The transport roller 12 is hard surfaced and defines the position of the medium in transport direction. Roller 13 is soft surfaced and pinches the medium onto the surface of the transport roller 12. The medium is transported by rotating transport roller 12 which is driven by drive motor 14 through an intermediate worm gear 15. In this embodiment, the transport roller has a diameter of 81.65 mm. A full revolution of this roller transports the medium across a distance of FR=256.5 mm. This is effected by NF=60 full revolutions of the drive motor and worm gear, resulting in a basic stepsize of FR/60=4.275 mm.

Figure 3:
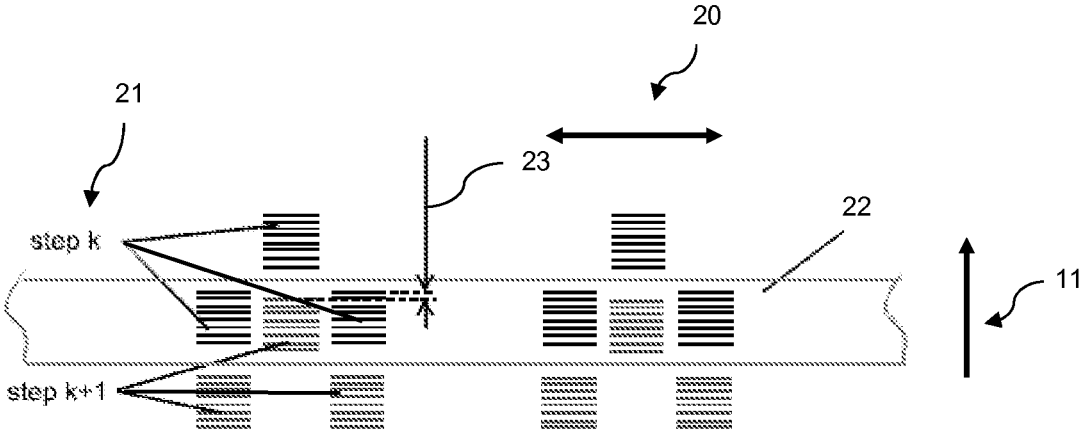
FIG. 3 shows a number of markers that are printed in order to determine an actual paperstep.

FIG. 3 shows the basic pattern of a measurement of a paperstep error. On the recording medium six markers are printed in sets of three markers. Step k at 21 indicates a swath k wherein a single printhead prints three markers on one side of the medium and three markers on an other side of the medium, the printhead moving in either one direction 20. After finishing the swath, the recording medium is transported in direction 11, applying a predetermined nominal paperstep. In a next swath, step k+1, the markers are printed once more, thereby placing one marker inbetween two previously printed markers. The optical capturing element 18 is configured to provide a digital image of an optical swath 22, which is more narrow than a print swath. From this digital image, a difference in the position of the neighboring markers 23 is derived, which can be determined very accurately by correlation techniques. This provides a paperstep error associated with the nominal paperstep in this particular position of the transporting components. A medium slip between the transport roller and the medium is disregarded in this analysis.

Example 1

In a calibration procedure, two nominal papersteps are applied: one equal to the basic step size of FR/60 and one slightly larger than that, FR/53. The cyclic disturbance is assumed to be of the form $$u(x) = \sum_{i=1}^{N} a(i)\sin\left[2\pi\omega(i)\frac{x}{FR} + \phi(i)\right], \tag{1}$$

wherein x is a distance along the circumference of the transport roller, a(i) is an amplitude, ω(i) is a periodicity of the disturbance, ϕ(i) is a phase of the disturbance, and i=1, . . ,N is an index, indicating a specific contributing periodic function. N is the number of these functions that are considered to be involved in the disturbance approximation. After step k (k=1, . . ,K), the distance x is:

$$x(k)=x(k-1)+\mathrm{STEP}(k), \tag{2}$$

wherein STEP(k) is one of the two nominal papersteps and x(0)=0. A good working selection of papersteps is an alternating one from the two applicable stepsizes, but alternative selections are very well possible.

A step error in step k is expressed as a relative position deviation $$e(k)=u(k)-u(k-1). \tag{3}$$

Thus, using $$a(i)\sin\left[2\pi\omega(i)\frac{x(k)}{FR} + \phi(i)\right] = \alpha(i)\sin\left[2\pi\omega(i)\frac{x(k)}{FR}\right] + \beta(i)\cos\left[2\pi\omega(i)\frac{x(k)}{FR}\right], \tag{4}$$

$$A(k, i) = \sin\left[2\pi\omega(i)\frac{x(k)}{FR}\right] - \sin\left[2\pi\omega(i)\frac{x(k-1)}{FR}\right], \tag{5a}$$

and $$B(k, i) = \cos\left[2\pi\omega(i)\frac{x(k)}{FR}\right] - \cos\left[2\pi\omega(i)\frac{x(k-1)}{FR}\right], \tag{5b}$$

the opimization problem is to find a minimum for $$\sum_{k=1}^{K}\left[m(k) - \sum_{i=1}^{N}\{A(k, i)\alpha(i) + B(k, i)\beta(i)\}\right]^2. \tag{6}$$

The measurements after step k are represented by m(k). The parameters α(i) and β(i), i=1, . . ,N determine the solution of the problem, given a set of N frequencies. For the above-mentioned system, a set of N=32 frequencies of {1, 2, . . . , 29, 60, 120, 180} are used, leaving 64 parameters to be found. A frequency of 1 corresponds to a full revolution of the roller. A minimum of 64 measurements is necessary to determine the required parameters. A larger number of measurements may be performed to improve the robustness of the solution to this mathematical problem, which is solved by a known method as described by K. J. Aström and B. Wittenmark in *Computer Control Systems,* 1984, p. 328. The contributions of the three highest frequencies to the cyclic disturbance would not have been found using a single step size of FR/60. A table for relating an actuation signal to a medium displacement is generated based on the finite series (1) using the found parameters.

Example 2

A second calibration procedure applies a randomly selected step size inbetween FR/60 and FR/30, based on a signal reconstruction method called compressive sampling. The same mathematical framework as in Example 1 is applied, with the difference that a number of addtional steps are applied to determine a set of relevant frequencies. In the specific system described above, the step sizes are randomly selected using a step size discretisation of FR/1515. This determines a maximum frequency that can be identified of 1515/2=707.5. To further enhance the speed of the procedure, a limited set of possible frequencies is used. In this example, only 1200 frequencies of the set {0.1, 0.2, 0.3, . . . , 120.0} are taken into account. The number of measurements again determines the obtained accuracy. A sufficient accuracy has been obtained by using 370 relative position measurements, which resulted in a 370 times 2400 matrix describing the relation between possible relevant calibration parameters and the relative error. Using the Gauss-Dantzig procedure (E. J. Candes, T. Tao, *Annals of Statistics, Vol.* 35(6), 2007, page 2313-2351) the limited (sparse) number of relevant parameters is identified. Thereby also the relevant frequencies ω(i) are estimated from the measurement data. The Gauss-Dantzig procedure requires to specify a threshold to set sufficiently small parameters to zero. This allows dealing with the influence of noise in the measurements. The threshold in this example has been set to 1 micrometer, corresponding to a standard deviation of the measurement error. In an instance of the aforementioned paper positioning system, the procedure was successful in identifying a set of relevant frequencies as {1, 2, 3, 23, 60, 71}. Three frequencies were artificially introduced in the actuation of the paper positioning system. Phase and amplitude of these frequencies were identified accurately.

In another embodiment, 400 relative position measurements were used. This number corresponds to 10 full revolutions of the transport roller, since the average step size is 1.5*FR/60. The 10 full revolutions correspond to the minimum frequency in the list of frequencies that are used for this system. A balance is struck between the number of measurements and the required accuracy, not only in order to limit the computational effort, but also to limit the amount of medium that is used in the calibration procedure.

Using the parameters found for the experimental data, a table of actual papersteps is constructed for every discrete value of the actuation signal for a full rotation of the transport roller. Besides yielding a more accurate determination of this table, the provided method enables the use of print strategies that require a paperstep different from an integer number of a basic step size.

Example 3

A third procedure based on this invention has been developed for a situation of a local deformation on the surface of the transport roller, for example due to a small counter roller pressing on the same position on the transport roller for a long period of time. Dependent on the quality of the transport roller material, in particular its resistance to plastic deformations, a dimple may occur, having a smaller size along the circumference of the roller than the basic stepsize, corresponding to a full revolution of the driving elements. In particular, when a transport roller is returned to a default standby position, a fixed dimple position has been observed. The depth of this dimple has an effect on the accuracy of the medium displacement and it is not possible to sample this dimple by using basic stepsizes only. Thus, a second stepsize is used, in addition to a basic stepsize d=FR/N, wherein FR=πD is the circumference of the transport roller, D is the average diameter of the transport roller and N the number of full rotations of the driving elements to obtain one single full rotation of the transport roller. This stepsize d' is selected such that an integer number N' of these stepsizes equals slightly more than a full rotation of the transport roller. This is expressed in the equality $$N'd' = FR + \frac{1}{m}d = FR\left(1 + \frac{1}{Nm}\right), \tag{7}$$

wherein m is the number of samples that is used to scan the dimple, or, in other words, the number of full rotations of the transport roller that is made before returning to an indexed position. In general, N' may be different from N, but in practice often the same value is used.

The local deformation correction is calculated by using a sum of Gaussian functions fit or a sum of high frequency sinusoidal functions fit. A window mask is used when more than one local deformation or dimple is present in the roller. This is done to isolate the effect of each dimple.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for accurately controlling a medium displacement in an inkjet printer by determining a relation between an actuation signal and a medium displacement, the actuation signal causing a rotation of a roller by actuating a drive motor that is coupled to the roller by a slip free transmission such that the rotation speed of the drive motor is higher than the rotation speed of the roller that passes its surface movement to a medium pinched onto its surface, the method comprising the steps of:

a) establishing a set of calibration actuation signals each corresponding to a nominal calibration step;

b) printing a first reference mark on the medium;

c) selecting a calibration actuation signal from the set of calibration actuation signals;

d) actuating the drive motor to cause the roller to displace the medium over a distance of the nominal calibration step corresponding to the selected calibration actuation signal;

e) printing a next reference mark besides the first reference mark in a direction perpendicular to the medium displacement direction;

f) optically reading the first and the next reference mark;

g) determining an achieved medium displacement step from the read reference marks; and h) repeating steps b) to g) for all available calibration actuation signals in the set of calibration actuation signals, wherein the set of calibration actuation signals comprises at least one calibration actuation signal that actuates the drive motor to make one full revolution and one calibration actuation signal that actuates the drive motor to make a rotation larger than one full revolution, but smaller than two full revolutions, and determining a relation between the calibration actuation signals and the difference between the achieved medium displacement steps and the nominal calibration steps, based on a finite series of basis functions.

2. The method according to claim 1, wherein the set of calibration actuation signals comprises two different values, that are applied a number of times in dependence on a required accuracy.

3. The method according to claim 1, wherein the set of calibration actuation signals comprises a number of randomly selected values, each calibration actuation signal value separately actuating the drive motor to make a rotation between one full revolution and two full revolutions.

4. The method according to claim 1, wherein the finite series of basis functions comprise a number of circular functions with a predetermined primitive period.

5. The method according to claim 1, wherein a number of calibration actuation signals that actuate the drive motor to make one full revolution are applied to obtain a provisional calibration table and a second number of calibration actuation signals that actuate the drive motor to make a slightly larger than one full revolution are applied to calibrate a local deformation in the roller.

6. An inkjet printer wherein a medium is transported to be printed in swaths, the inkjet printer having a control unit that is configured to execute the method of claim 1.

* * * * *